US007756278B2

(12) United States Patent
Moorer

(10) Patent No.: US 7,756,278 B2
(45) Date of Patent: Jul. 13, 2010

(54) ULTRA-DIRECTIONAL MICROPHONES

(76) Inventor: James A. Moorer, 639 Bamboo Ter., San Rafael, CA (US) 94903-3153

( * ) Notice: Subject to any disclaimer, the term of this patent is extended or adjusted under 35 U.S.C. 154(b) by 1049 days.

(21) Appl. No.: 11/419,460

(22) Filed: May 19, 2006

(65) Prior Publication Data

US 2006/0198537 A1 Sep. 7, 2006

Related U.S. Application Data

(63) Continuation of application No. 09/919,742, filed on Jul. 31, 2001, now Pat. No. 7,068,796.

(51) Int. Cl.
*H04R 3/00* (2006.01)

(52) U.S. Cl. ..... 381/92; 381/111

(58) Field of Classification Search ..... 381/92, 381/356, 122, 118, 119, 111; 367/118–130
See application file for complete search history.

(56) References Cited

U.S. PATENT DOCUMENTS 4,281,551 A * 8/1981 Gaudriot et al. ..... 73/647
4,703,506 A 10/1987 Sakamoto et al.
4,741,038 A 4/1988 Elko et al.
4,802,227 A 1/1989 Elko et al.
4,922,536 A 5/1990 Hoque
5,051,799 A 9/1991 Paul et al.
5,058,170 A 10/1991 Kanamori et al.
5,483,599 A 1/1996 Zagorski
5,684,882 A 11/1997 Mahieux et al.
5,737,430 A 4/1998 Widrow
5,793,875 A * 8/1998 Lehr et al. ..... 381/313
5,848,170 A 12/1998 Mahieux et al.
5,940,118 A 8/1999 Van Schyndel (Continued)

FOREIGN PATENT DOCUMENTS

GB 2097121 10/1982

(Continued)

OTHER PUBLICATIONS

Joseph Lardies, "Acoustic Ring Array with Constant Beamwidth Over a Very Wide Frequency Range", Acoustics Letter vol. 13, No. 5, 1989, pp. 77-81.*

(Continued)

*Primary Examiner*—Curtis Kuntz
*Assistant Examiner*—Hai Phan
(74) *Attorney, Agent, or Firm*—Stolowitz Ford Cowger LLP

(57) ABSTRACT

Some embodiments provides a highly directional audio response that is flat over five octaves or more by the use of multiple colinear arrays followed by signal processing. Each of the colinear arrays has a common center, but a different spacing so that it can be used for a different frequency range. The response of the microphones for each spacing are combined and filtered so that when the filtered responses are added, the combined response is flat over the selected frequency range. To improve the response, the output of the microphones for a given array spacing can also be filtered with windowing functions. To receive the response from other directions a "steering" delay may also be introduced in the microphone signals before they are combined. Some embodiments can also extend to two and three dimensional arrays.

42 Claims, 11 Drawing Sheets

U.S. PATENT DOCUMENTS

| | | | | |
|---|---|---|---|---|
| 6,952,697 | B1 | 10/2005 | Rothschild | |
| 7,133,530 | B2 * | 11/2006 | Poletti | 381/92 |
| 2002/0009203 | A1 * | 1/2002 | Erten | 381/92 |

FOREIGN PATENT DOCUMENTS

| | | |
|---|---|---|
| GB | 2104218 | 3/1983 |
| WO | 9927754 | 6/1999 |
| WO | 9953336 | 10/1999 |
| WO | 0052959 | 9/2000 |

OTHER PUBLICATIONS

Peacock, Kenneth L., "On the Practical Design of Discrete Velocity Filters for Seismic Data Processing," IEEE Transactions on Acoustics, Speech, and Signal Processing, vol. ASSP-30, No. 1, Feb. 1982, pp. 52-60.

Gerzon, Michael, "Ultra-Directional Microphones: Applications of Blumlein Difference Technique: Part 1," Studio Sound, vol. 12, Oct. 1970, pp. 434-437.

Gerzon, Michael, "Ultra-Directional Microphones: Applications of Blumlein Difference Technique: Part 2," Studio Sound, vol. 12, Nov. 1970, pp. 501-504.

Gerzon, Michael, "Ultra-Directional Microphones: Applications of Blumlein Difference Technique: Part 3," Studio Sound, vol. 12, Dec. 1970, pp. 539-543.

Skolnik, Merrill I., Radar Handbook, 1990.

Harry F. Olson "Directional Microphones," Journal of the Audio Engineering Society, Oct. 1967.

B.R. Beavers, R. Brown "Third-Order Gradient Microphone for Speech Reception" Journal of the Audio Engineering Society, Dec. 1970.

Note: These two articles, 1) and 2), are included in Microphones: An Anthology of Articles on Microphones from the Pages of the Journal of the Audio. Section 9.1, pp. 128-134, of Leland B. Jackson "Digital Filters and Signal Processing," Kluwer Academic Publishers, Hingham, MA USA, 1996.

Sections 2.5 and 8.6 of Gene H. Golub, Charles F. Van Loan "Matrix Computations: Third Edition" Johns Hopkins University Press, Baltimore MD USA, 1996.

J.H. McClellan, T.W. Parks, L.R. Rabiner "A Computer Program for Designing Optimum FIR Linear Phase Digital Filters" IEEE Transactions on Audio and Electroacoustics, vol. AU-21, pp. 506-526, Dec. 1973.

Andrew G. Deczky "Synthesis of Recursive Digital Filters Using the Minimum p-Error Criterion" IEEE Transactions on Audio and Electroacoustics, vol. AU-20, pp. 257-263, Oct. 1972.

Metcalfe, R.M., and Boggs, D.R. "Ethernet: Distributed Packet Switching for Local Computer Networks", Communications of the ACM, vol. 19, No. 7, pp. 395-404, Jul. 1976.

Patrick M. Peterson "Adaptive Array Processing for Multiple Microphone Hearing Aids" RLE Technical Report No. 541, Feb. 1989. (This is from: RLE (Research Laboratory of Electronics), MIT, Cambridge, MA 02139.

Chou, Thomas, "Frequency-Independent Beamformer With Low Response Error," IEEE Conference on Acoustics, Speech, and Signal Processing, vol. 5, pp. 2995-2998, 1995.

Berhout et al., "Acoustic Control By Wave-Field Synthesis," Journal of the Acoustic Society of America, vol. 5, pp. 2764-2778, 1993.

Goodwin, Michael M.; Elko, Gary W., "Constant Beamwidth Beamforming," IEEE Conference on Acoustics, Speech, and Signal Processing, vol. 4, pp. I-169-I-172, 1993.

Flanagan, J.H. et al., "Autodirective Micro Systems," Acustica, vol. 73, pp. 58-71, 1991.

* cited by examiner

1200

1400

ULTRA-DIRECTIONAL MICROPHONES

PRIORITY CLAIM

This application is a continuation of application Ser. No. 09/919,742, filed Jul. 31, 2001, and entitled ULTRA-DIRECTIONAL MICROPHONES which is incorporated herein by reference in its entirety.

BACKGROUND OF THE INVENTION

1. Field of the Invention

This invention relates generally to microphone systems, and, more specifically, to highly directional microphones providing a flat frequency response.

2. Background Information

In the reception and recording of sound, there are many applications when it is useful to have directional microphones. The standard technique is to rely on the directional response of microphone that is itself directional, such as a pressure gradient or "shotgun" type microphone. These microphones are limited both in the directionality of response and in the flatness frequency response. Various aspects of directional microphones of "classical" design are discussed in a number of articles, such as: Harry F. Olson "Directional Microphones," Journal of the Audio Engineering Society, October 1967, and B. R. Beavers, R. Brown "Third-Order Gradient Microphone for Speech Reception" Journal of the Audio Engineering Society, December 1970. These two articles are included in "Microphones: An Anthology of Articles on Microphones from the Pages of the Journal of the Audio Engineering Society" Publications office of the Audio Engineering Society (1979), which is hereby incorporated by this references.

In a series of articles dating from the early 1970's, Michel Gerzon suggested using cancellation between two adjacent microphones to achieve high directionality in a limited frequency range. This is described in a series of articles: "Ultra-Directional Microphones: Applications of Blumlein Difference Technique: Part 1" Studio Sound, Volume 12, pp 434-437, October 1970; "Ultra-Directional Microphones: Applications of Blumlein Difference Technique: Part 2" Studio Sound, Volume 12, 501-504, November 1970; and "Ultra-Directional Microphones:

Applications of Blumlein Difference Technique: Part 3" Studio Sound, Volume 12, 539-543, December 1970, which are all hereby incorporated by reference. This is also similar to the techniques used in certain aspects of phased-array radar. By combining the output of the microphones, the interference between the outputs adds constructively in a direction perpendicular to the axis connecting the microphones, but cancels to a varying degree in other directions.

Although this results in a high degree of directionality to the response, it is highly dependent upon the relation between the microphones' spacing and the frequency of the sound. Although radar and other applications only require sensitivity in a fairly narrow frequency range, audio applications may require that the frequency response be flat over a sizable portion of the audio range.

SUMMARY OF THE INVENTION

The present invention provides a highly directional audio response that is flat over five octaves or more by the use of multiple colinear arrays followed by signal processing. In a preferred embodiment, each of the colinear arrays has a common center, but a different spacing so that it can be used for a different frequency range. The response of the microphones for each spacing are combined and filtered. The frequency response of each filter is selected so that when the filtered responses are added, this combined response is flat over the selected frequency range. The size and limits of the selected frequency range are not limited and can be extended by increasing the number of arrays and filters used.

To improve the response, the output of the microphones for a given array spacing can also be filtered with windowing functions. This helps reduce the array response for directions not directly in front of the array. To receive the response from other directions a "steering" delay may also be introduced in the microphone signals before they are combined. The microphone signals may either be supplied directly from the microphones or have been previously recorded from the microphones' outputs.

The invention also extends to two and three dimensional arrays. By introducing arrays with several regular spacings in two or three dimensions, the response can centered in any direction. In one embodiment, a two-dimensional microphone array "fabric" is composed of a grid of combined transducer, preprocessor, and network interface units.

Additional aspects, features and advantages of the present invention are included in the following description of specific representative embodiments, which description should be taken in conjunction with the accompanying drawings.

DESCRIPTION OF REPRESENTATIVE EMBODIMENTS

Figure 1:
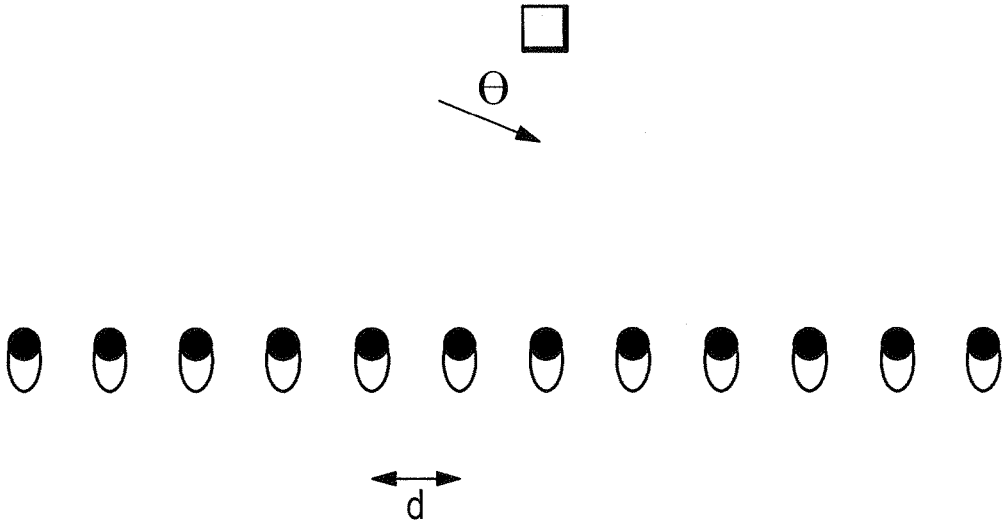
FIG. 1 shows a linear array of microphones with a spacing of d.

The discussion starts with an array of microphones placed at equal distances along a line, as shown in FIG. 1. Let d be their separation. Let a plane wave impinge on the array at an angle of θ from the perpendicular to the array. Assume that the plane wave is a sinusoid with a wavelength of λ. If n is the number of microphones, then the response to the plane wave in microphone k can be written as follows:

$$\sin\left(2\pi\frac{c}{\lambda}\left(t+\frac{kd}{c}\sin\theta\right)\right) \tag{1}$$

For convenience, let the number of microphones be odd, and call the center microphone number zero. The discussion readily extends to the even number case, although the odd case is presented more fully here as it allows a greater degree of microphone sharing between different spacing in arrangements such as FIG. 5. The variable t represents time in seconds. If these signals are summed over all the microphones and simplify, the following is obtained:

$$\sin\left(2\pi\frac{c}{\lambda}t\right)\left\{1+2\sum_{k=1}^{(n-1)/2}\cos\left(2\pi\frac{kd}{\lambda}\sin\theta\right)\right\} \tag{2}$$

The second term of the above represents the amplitude of the resulting sum. This is plotted for various values of wavelength in FIG. 2, that shows the amplitude of the response of the sum of all the feeds from the microphone array with changing angle of incidence. Each curve represents a different wavelength from 1.5 d (narrowest) 201 to 6 d (widest) 210. Note that the maximum response is developed in a direction perpendicular to the microphone array. The varying width of the response maximum show that different wavelengths will have different pickup patterns.

The entire array can be "steered" by applying a simple delay to each microphone as follows:

$$\Delta t_k = \frac{-kd}{c}\sin\phi, \tag{3}$$

where ϕ is the angle where the greatest sensitivity is desired.

Figure 3:
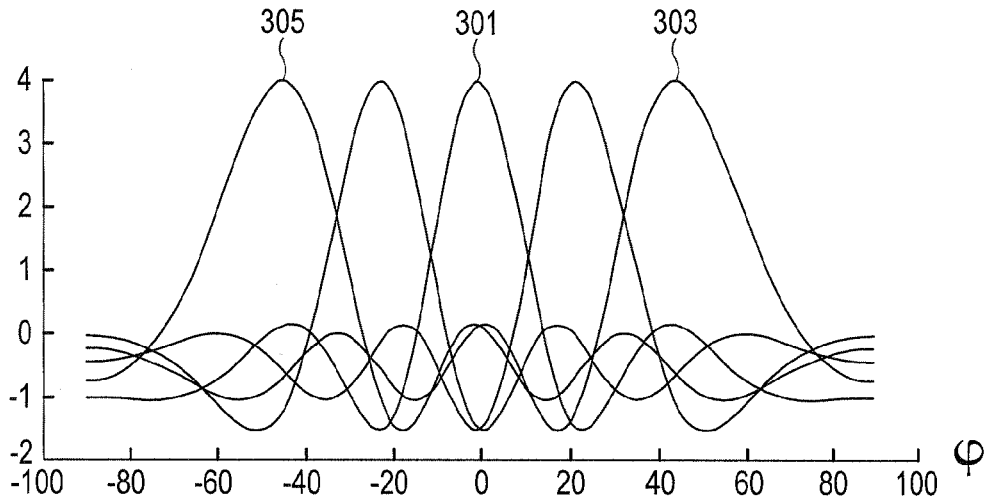
FIG. 3 shows the effect of "steering" the array by adding a simple delay to each microphone.

This has the effect of moving the maximum of the response of the array, but it also changes the width of the center lobe. FIG. 3 shows the effect of "steering" the array from −45° 305 to 45° 303, with curve 301 showing ϕ=0°. The wavelength of the test signal was set to a constant 2.5 d. Note that the main response widens a bit as the array is steered away from the center. This is because the "effective" microphone spacing is reduced by the cosine of the angle.

Figure 4:
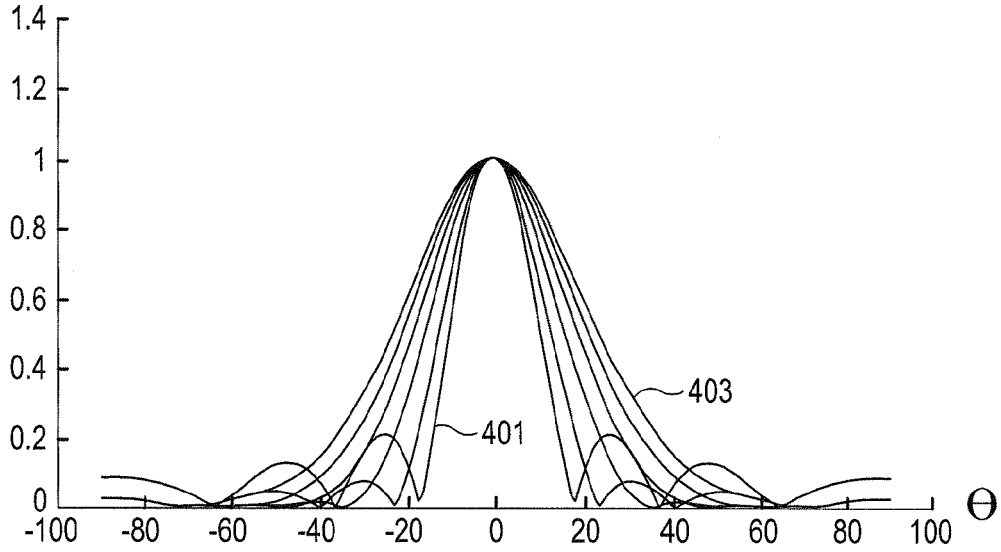
FIG. 4 shows the effect of using a window function to change the tradeoff between center lobe width and side lobe suppression.

Since the amplitude term in equation (1) resembles a Fourier series, the use of window functions can change the tradeoff between center lobe width and side lobe suppression. FIG. 4 shows the effect of changing the strength of the window. The window was the Kaiser-Bessel window with the β parameter varying between 0.5 in curve 401 and 5.5 in curve 403, where lobe width increases with increasing window strength. More information on window functions is given, for example, in Leland B. Jackson "Digital Filters and Signal Processing," Kluwer Academic Publishers, Hingham, Mass. USA, 1986—see Section 9.1, pp 128-134, which is hereby incorporated by this reference.

So far, this is discussion is based on that from phased-array radar technology, described, for example, chapter 7 of "Radar Handbook" by Merrill I. Skolnik, McGraw-Hill, Inc., 1990, which is hereby included by reference. To make this more useful for audio, the system should preferable produce uniform lobed width over the relevant frequencies and achieve a flat frequency response over five or more octaves, preferably a 10-octave range of roughly 20 Hz to 20 kHz. The reason for uniform lobe width is to reduce the coloration of the sound in the principal direction of the array. Since the array depends on cancellation and reinforcement of the wave fronts, it is necessarily a highly frequency-dependent process and is preferably followed with sufficient processing to minimize the frequency dependencies.

The basic array exhibits reasonable response over about 2 octaves covering wavelengths from about 1.5 d and 6 d. Wavelengths longer than this produces very wide principal lobes, and wavelengths shorter than this produce multiple principal lobes. The center octave of this (in a geometric-mean sense) can be taken as the main region of response, which is from about 2.12 d to about 4.14 d. The remainder of the response range will be used to overlap with other arrays that cover other octaves.

Figure 5:
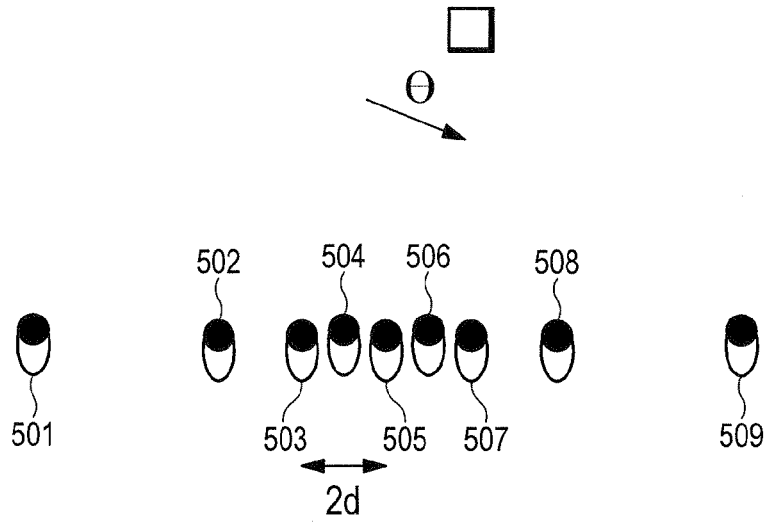
FIG. 5 shows three overlapping arrays sharing center microphones.

A wide response can be obtained by having multiple arrays on the same line with the same microphone in the center. FIG. 5 shows a simplified diagram with three colinear arrays with spacings at d, 2 d and 4 d and five microphones for each spacing. For example, microphone 503 has both the spacings d and 2 d and microphone 502 has both the spacings 2 d and 4 d. To cover the full audio range with equal spatial resolution, an exemplary embodiment would have a total of ten array spacings. Each array will contribute one octave of frequency response to the overall result. The upper and lower half-octave of each array will overlap with the adjacent arrays.

The next aspect to be addressed is control of the width of the principal lobe. As noted above, a window function can be used to adjust the width of the center lobe. Since a different lobe width is preferably used at each different frequency, the output of each array is filtered with individual filters that are designed to realize a certain window function at each frequency. The filters should also sum properly with the responses of adjacent arrays to produce flat frequency response and uniform lobe width when summed over all the arrays.

Figure 6:
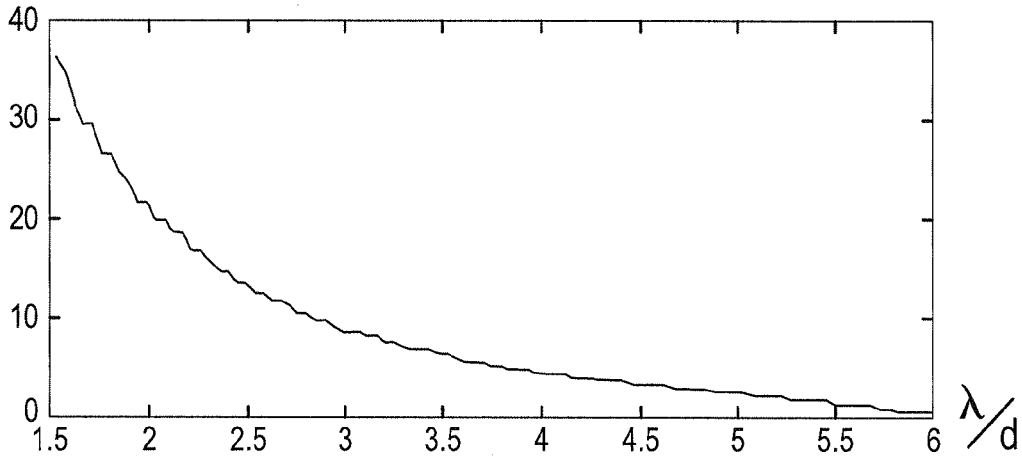
FIG. 6 is a plot of Beta parameter to Kaiser-Bessel window for values of wavelength in multiples of the microphone spacing.

Since window functions make the lobe wider, it is preferable to take the widest lobe width and match all the other widths to this. The widest lobe in the range of interest occurs at 6 d. A simple optimization can derive values of the beta parameter of the Kaiser-Bessel window that give us the desired window width. FIG. 6 shows the result of such an optimization. FIG. 6 is a plot of the beta parameter to Kaiser-Bessel window for values of wavelength expressed in multiples of the microphone spacing. These values of beta equalize the main lobe widths for the given wavelength. This curve appears to be largely independent of the number of microphones in the array. As the wavelength moves from 6 d down to 1.5 d, the beta parameter can be increased steadily to widen the principal lobe.

Figure 7:
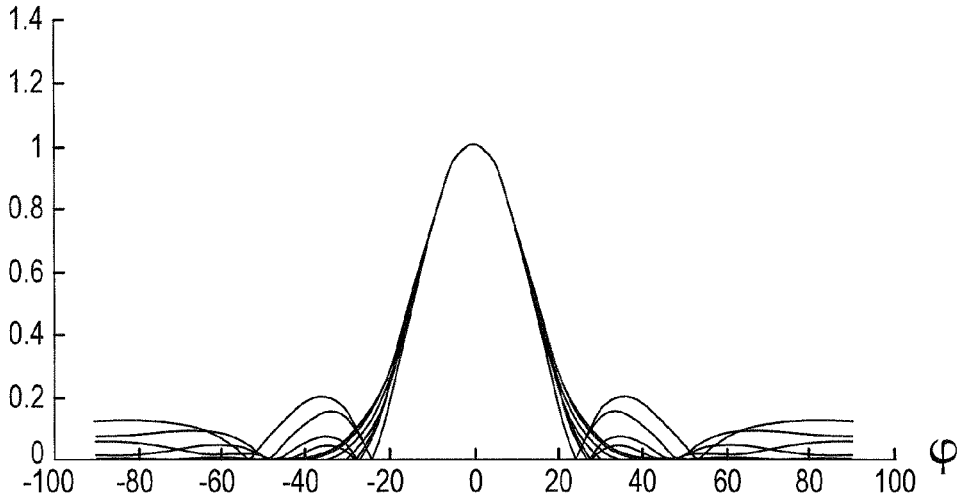
FIG. 7 shows lobe widths after normalization by adjusting the Beta parameter of the Kaiser-Bessel window.

FIG. 7 shows the result of applying different window functions to the array at different wavelengths and shows lobe widths after normalization by adjusting the Beta parameter of the Kaiser-Bessel window. The wavelengths span the range from 1.5 d to 6 d. Note that the sideband gain increases at the ends of the frequency range due to the windowing. This is using 15 microphones in a single array. Note that at the shortest wavelength, the sideband rejection starts to rise again, probably due to the effective "shortening" of the array.

Figure 8:
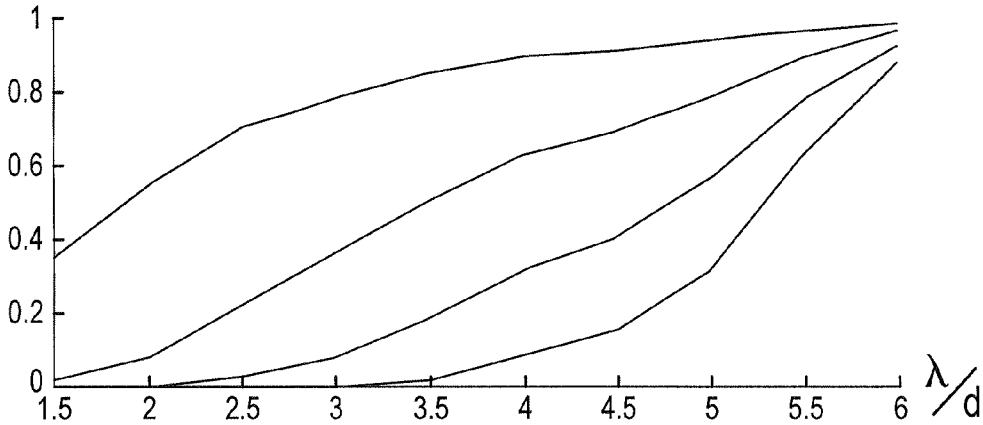
FIG. 8 are typical windowing gain curves representing particular points of the Kaiser-Bessel window as the Beta parameter is swept as shown in FIG. 6.

FIG. 8 is a typical windowing gain curves for four microphones in a 9-microphone array at various values of wavelength (in multiples of d). These represent particular points of the Kaiser-Bessel window as the Beta parameter is swept as shown in FIG. 6. The upper curve represents the center microphone, and the center point of the window function.

There is nothing particularly special about the Kaiser-Bessel window. It is used here simply because it comes with a single parameter that controls the width of the window in a smooth, continuous, and monotonic fashion. One could equally derive an "optimum" window by a least-squares technique. This would allow "fine tuning" the response at any given frequency by adjusting the tradeoff between matching the center lobe to the prototype response (which is the response at the longest wavelength, 6 d) to the off-axis response. Note in FIG. 6 that the off-axis peaks get greater as the wavelength gets longer. This is to be expected, since smaller values of Beta allow the sidelobes to increase in amplitude. Defining a window function, $w_k$, then define a weighting function at each angle as $p_i$. An objective function can then be described as follows:

$$F = \sum_{i=1}^{M} p_i \left\{ D_i - 1 - 2 \sum_{k=1}^{(n-1)/2} w_k \cos\left(2\pi \frac{kd}{\lambda} \sin\theta_i\right) \right\}^2 \tag{4}$$

where $D_i$ represents the "desired" response. In the present example case, a desired response can be produced by windowing the response at the maximum wavelength of 6 d. Using this as the prototype response, this can be matched as closely as desired by choosing the weighting function, $p_i$, and finding the window function coefficients, $w_k$, that minimize F in equation (4). Since the response of the array is linear with respect to any given window coefficient, equation (4) represents a linear least-squares problem. The normal equations can be formed and solved by any number of methods, such as singular-value decomposition (described, for example, in sections 2.5 and 8.6 of Gene H. Golub, Charles F. Van Loan "Matrix Computations: Third Edition" Johns Hopkins University Press, Baltimore Md. USA, 1996, which is hereby incorporated by reference). One might choose, for instance, $p_i \equiv 1$ to match the desired response as well as possible over the entire function. One might choose $p_i=10$ over the main lobe and $p_i=1$ elsewhere to force the response to match the desired response as well as possible at the main lobe and less well outside the main lobe.

Since the Kaiser-Bessel window is relatively simple, this embodiment is used in the remainder of this discussion with the understanding that any suitable window that allows matching of the principal lobes can be used.

To implement a window function that varies with frequency, a filter is implemented for each microphone that has the desired gain at each wavelength. This gain is determined by the value of the Kaiser-Bessel window for that microphone at the value of beta indicated by the curve of FIG. 6. The resulting window function is, in fact, a family of window functions, since the window function will be different for each different frequency. This can be represented this as $w_k(\lambda)$ for the weighting of microphone k at a wavelength of $\lambda$. FIG. 7 shows a plot of four different microphone coefficients as functions of wavelength. These represent the filters that must be realized to produce equal main lobe widths over the frequency range of interest. There are many ways to calculate the filter coefficients, such as the methods described in Leland B. Jackson "Digital Filters and Signal Processing," that was incorporated by reference above, or either of J. H. McClellan, T. W. Parks, L. R. Rabiner "A Computer Program for Designing Optimum FIR Linear Phase Digital Filters" IEEE Transactions on Audio and Electroacoustics, Volume AU-21, pp 506-526, December 1973, or Andrew G. Deczky "Synthesis of Recursive Digital Filters Using the Minimum p-Error Criterion" IEEE Transactions on Audio and Electroacoustics, Volume AU-20, pp 257-263, October 1972, which are both hereby incorporated by reference. Since a filter will respond over the entire range, it is not necessary to specify the curves outside of the range shown in FIG. 7. It is sufficient to just extend the curves to zero frequency and the Nyquist rate by simply duplicating the values at the end points shown in FIG. 7. That is, the response of the filter at wavelengths greater than 6 d can have the same response at a wavelength of 6 d, and wavelengths shorter than 1.5 d can have the same response as at a wavelength of 1.5 d. These values are somewhat arbitrary but are sufficient to produce a working design.

Note that window functions are symmetric. This means that for an array of n microphone, only (n−1)/2 windowing filters need be implemented. Microphones on each side of the center microphone may be summed before filtering, thus eliminating the need for a number of filters, although the steering delays will differ for the two sides.

Figure 9:
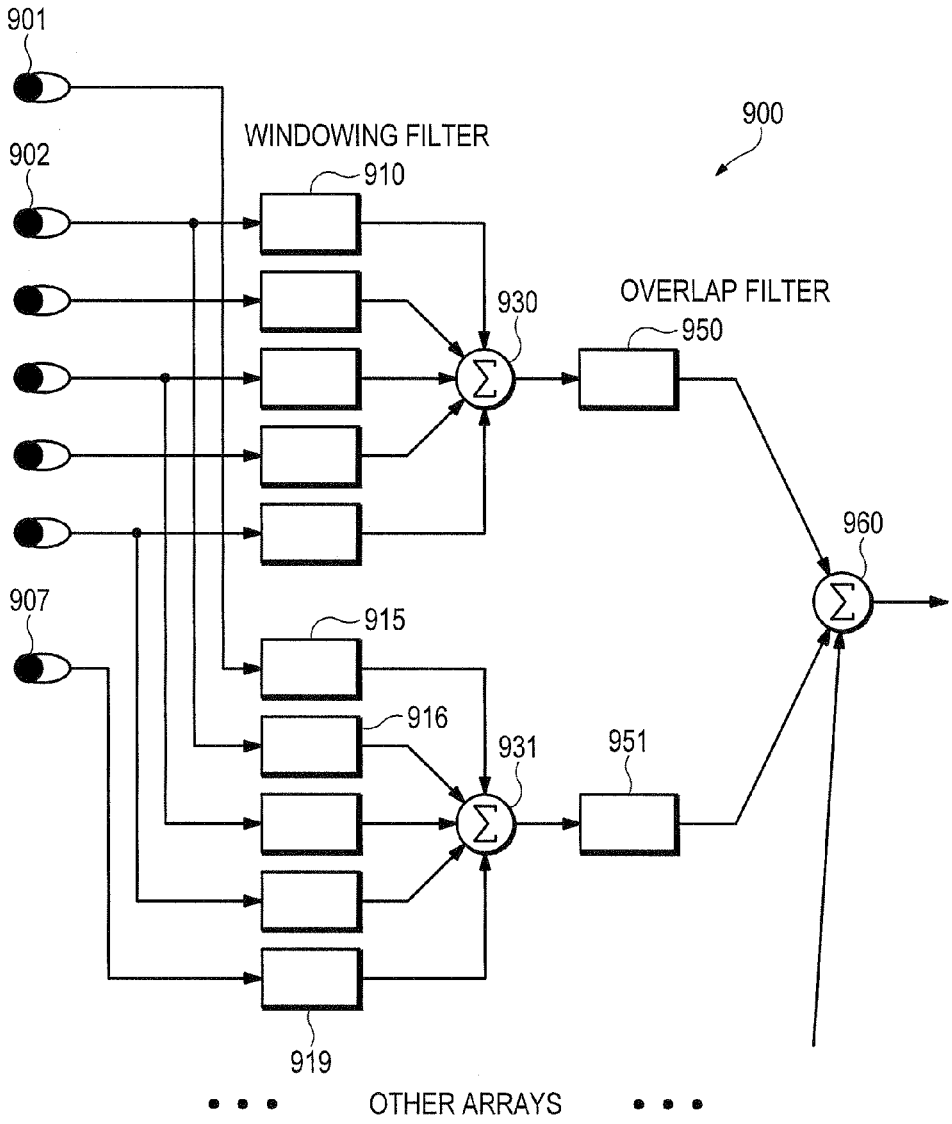
FIG. 9 is a block diagram of processing for overlapped microphone arrays.

FIG. 9 is a block diagram of processing for overlapped microphone arrays in an exemplary embodiment with two spacings, each having five microphones. Each microphone goes to a filter that implements the frequency-dependent window and the "steering" delay, if these are included. For example, microphone 901, which corresponds to a spacing 2 d, goes into windowing filter 915. Microphone 902, which corresponds to a spacing of both d and 2 d, goes to two windowing filters, being connected to adder 930 for the spacing d through the filter 930 and being connected to adder 931 for the spacing 2 d through the filter 916.

Each windowed array is then filtered so that the arrays overlap properly to produce an overall flat response when combined by adder 960. Here, the array with the spacing d is filtered through overlap filter 950 after the windowed responses are combined in adder 930, with filter 951 and adder 931 serving the function for the array with spacing 2 d. One windowing filter is shown for each microphone for clarity. Since the window functions are symmetric, pairs of microphones equidistant from the center microphone, for example 901 and 907, could be summed (after receiving the appropriate steering delay), then filtered by a single frequency-dependent window filter so that, in the case of 901 and 907, filters 915 and 919 would then be the same filter. If it is desired to simultaneously receive signals from different directions (that is, with the array "steered" to different angles), then separate processing would have to be supplied for each desired angle. Of course, the direct microphone feeds could be stored and processed to extract signals at different angles at a later time.

As noted above, each array covers about two octaves. This can be separated into the main region, from about 2.12 d to about 4.14 d, and the overlap regions, which constitute the remainder of the full two octave range. At the extremes of the frequency range, there is no overlap, so the highest array will cover up to 1.5 $d_r$ and the lowest array will cover down to 6 $d_1$, where $d_j$ represents the microphone spacing of array j. Using 24 kHz as the highest frequency for which coverage is desired and using the spacings d, 2 d, . . . , $2^{(N-1)}$d, this results in setting the spacing of the microphones in the highest frequency array as about 1 cm. From this, the results of

TABLE 1

Table 1 can be derived:

| Microphone Spacing | Low Frequency | High Frequency |
|---|---|---|
| 1 cm | 8000 Hz | 22067 Hz |
| 2 cm | 4000 Hz | 8000 Hz |
| 4 cm | 2000 Hz | 4000 Hz |
| 8 cm | 1000 Hz | 2000 Hz |
| 16 cm | 500 Hz | 1000 Hz |
| 32 cm | 250 Hz | 500 Hz |
| 64 cm | 125 Hz | 250 Hz |
| 1.28 m | 62.5 Hz | 125 Hz |
| 2.56 m | 22.11 Hz | 62.5 Hz |

More generally, if the minimum spacing is taken to be centered at a frequency of, say, 3-20 kHz, this corresponds to a d in the range of about 10 cm≧d≧0.5 cm.

The frequencies of Table 1 are not exact, but have been rounded to convenient boundaries for clarity. Note again that the highest frequency array extends from 1.5 d to 4.14 d, and the lowest frequency band extends from 2.12 d to 6 d. All the others extend from 2.12 d to 4.14 d. This shows that the entire frequency range may be captured by 9 collinear arrays, each having twice the spacing of the next. If desired, the larger arrays at lower frequencies may be eliminated. The only effect of this is that the pickup will not be highly directional at low frequencies due to the widening of the principal lobe of the array response.

Note again that steering the array away from angle zero (straight ahead) does have the effect of widening the principal lobes, since it lowers the effective distance between the microphones. This table was computed at angle zero. Alternately the table can be based on a different angle. To be as consistent as possible, it may be preferable to compute a different set of frequency-dependent window functions for each desired pickup angle so that the principal lobe width would be constant over the entire steering range of the array, which is from −45° to 45°. For many applications, however, it is acceptable to allow the width of the principal lobe to change, as long as other properties of the array are preserved, such as overall frequency response flatness, and matching of the principal lobes among the arrays to prevent coloration of the sound in the principal lobe.

In addition to the filtering described above to apply the frequency-dependent window function to each microphone in each array, there is a filter that is applied to the total response from a given array so that each array contributes to the overall response mainly in its principal frequency region. It is preferable that the sum of the responses across all the arrays be flat over the audible range. This can be expressed by considering the impulse response of each array, then stating conditions on these responses which represent the design goals. For convenience the impulse response of each array can be taken as symmetric. This is not strictly necessary, but it guarantees that there will be no phase variance from one array to the next. If the impulse response of filter i at a time point s is represented by $h_{is}$, the conditions for flatness of overall frequency response can be stated as follows:

$$\sum_i h_{is} = \begin{cases} 1, & s = 0 \\ 0, & s \neq 0 \end{cases} \tag{5}$$

This is necessary and sufficient to guarantee perfectly flat frequency response. In general, this condition will not be met exactly. All that is required is that the deviation from identity be sufficiently small so it is not heard as an excessive coloration of the sound.

To compute the overlap filters, the process can start by first creating an "ideal" prototype filter that is constructed so that it overlaps perfectly, followed by computing approximations to the prototype filter using standard approximation techniques (see, for example, J. H. McClellan, T. W. Parks, L. R. Rabiner "A Computer Program for Designing Optimum FIR Linear Phase Digital Filters" incorporated by reference above). Although a separate prototype filter is preferably created for each band, there are some similarities that make the process simpler. The process can separate the filters into the two at the extremes of frequency, and all the rest. For the filters that are not at the extremes, it can be required that they are identical, except that each band spans twice the frequency of the previous band. For example, if a particular frequency band goes from f to 2 f then a filter can be defined as follows:

$$f_c \equiv (4/3)f \tag{6}$$

$$f_1 \equiv (2/3)f \tag{7}$$

$$f_2 \equiv (8/3)f \tag{8}$$

$$H(\vartheta) = \begin{cases} 0 & \vartheta < f_1 \\ (\vartheta - f_1)/(f_c - f_1) & f_1 \leq \vartheta < f_c \\ (f_2 - \vartheta)/(f_2 - f_c) & f_c \leq \vartheta < f_2 \\ 0 & f_2 \leq \vartheta \end{cases} \tag{9}$$

Figure 10:
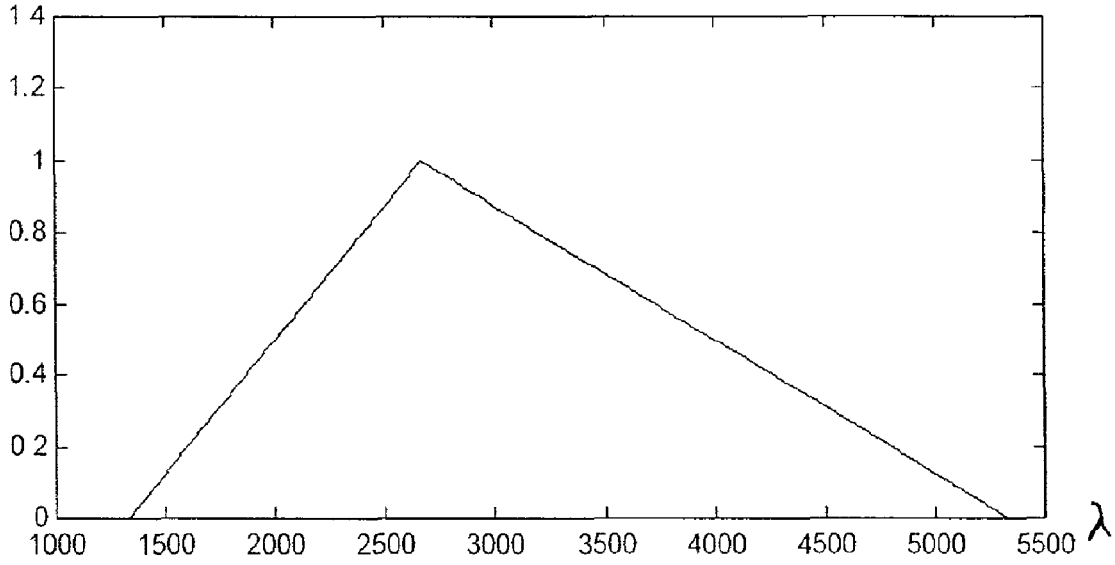
FIG. 10 shows the response of one kind of prototype overlap filter covering the band from 2000 Hz to 4000 Hz.

FIG. 10 shows a plot of this function for the frequency band 2000-4000 Hz. As noted, the filter extends down to 1333 Hz and up to 5333 Hz for proper overlap. It will perfectly overlap the filters in the next higher and next lower frequency bands, and the sum of these overlapping filters is exactly one by construction. The filter for the next higher or lower frequency band may be obtained simply by relabeling the frequency axis with either twice the frequencies or half the frequencies. Of course, this filter design is not unique. There are many suitable choices for the overlap filter that have this property.

At the extremes of frequency, the filter can simply be taken to stay at unity gain on one side or the other. Using the definitions above, the filters for the extremes can be defined as follows:

$$H(\vartheta) = \begin{cases} 1 & \vartheta < f_c \\ (f_2 - \vartheta)/(f_2 - f_c) & f_c \leq \vartheta < f_2 \\ 0 & f_2 \leq \vartheta \end{cases} \tag{10}$$

$$H(\vartheta) = \begin{cases} 0 & \vartheta < f_1 \\ (\vartheta - f_1)/(f_c - f_1) & f_1 \leq \vartheta < f_c \\ 1 & f_c \leq \vartheta \end{cases} \tag{11}$$

The above description is somewhat careless with the notation, in that the above formulas all use the same symbols for the important frequencies ($f_1$, $f_2$, and $f_c$), but this is intended them to apply just to the particular band of interest. As noted above, for the band from 2000 to 4000 Hz, $f_1$ would be 1333 Hz, and $f_2$ would be 5333 Hz. For other bands, these frequencies would be scaled appropriately to represent the frequency range of the particular band. As an example, in the lowest band as shown in the table above, $f_c$ would be 41.667 Hz, and $f_2$ would be 83.333 Hz. Equation (10) represents the lowest filter, which extends down to zero frequency.

Having defined a suitable set of prototype filters for overlapping the microphone arrays, filter coefficients that approximate these filters to any degree of accuracy may be computed. If the filters are all of zero-phase, then they will sum to an approximation of an impulse, described by Equation (5). This is by construction. Since the sum of all the prototype filters is unity, the resulting impulse response must be a simple impulse. Consequently, the sum of a series of filters that approximate the prototype filters will naturally be an approximation to an impulse. Of course, if the filters are not of zero-phase or linear-phase design, they will not necessarily sum to an impulse.

It should be noted that as the array is steered so that the principal lobe is at a non-zero angle, the effective shortening of the microphone spacing by the factor of $\cos(\theta)$ indicates that all the filters, both the windowing filters and the overlapping filters, should be recomputed using a microphone spacing of $d\cos(\theta)$. Additionally, the beta parameter of the Kaiser-Bessel window (or whatever window function is used) may be adjusted so that the width of the principal lobes remains constant over the usable steering range of −45° to 45°.

There has been an implicit decision in the above to implement the frequency-dependent window function and the overlapping filter using FIR, or finite impulse-response filters. This is not strictly necessary, but it allows the use of perfectly linear-phase filters. A linear-phase filter has an inherent delay in the signal path. If all the filters have the same number of multiplies, then they will all exhibit the same delay, and they may be summed. If the filters do not have the same number of multiplies, then the delays should be equalized before summing the results of the windowing filters. These delays can be offset by combining them with the delays necessary for "steering" the array (Equation (3)). If some microphones end up with negative delays, then all the microphones must be delayed to assure causality.

Figure 11:
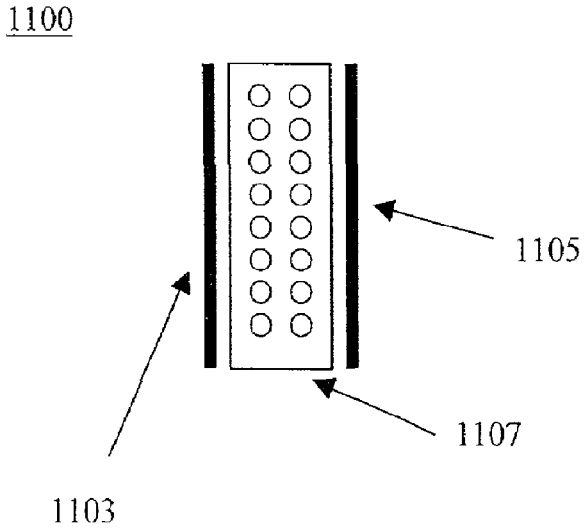
FIG. 11 is a diagram of a pressure-gradient condenser microphone.

So far, the directional characteristics of the individual microphones in the array have not been discussed. This discussion is perfectly accurate if the microphones are omnidirectional. Some modifications to the exposition can be made to show the effect of directional microphones, such as the pressure-gradient type. FIG. 11 shows a schematic representation of a pressure-gradient condenser microphone 1100. Typically, the neutral interior capsule 1107 is held at ground, and the variations of capacitance between the anterior and posterior diaphragms, respectively 1103 and 1105, and the capsule 1107 generate a voltage. To obtain directional characteristics, the voltages of the anterior and posterior diaphragms may be weighted and subtracted. This produces the familiar directional patterns, such as cardioid, hypercardioid, and so on.

This kind of microphone has the following angular response:

$$C+(1-C)\cos(\theta) \tag{12}$$

The response straight ahead (zero angle) is exactly one. The response to the rear is (2C−1). For a cardioid pattern, C is set to one-half, so the response to the rear is exactly zero. Other values of C produce different patterns.

The effect of using a pressure-gradient microphone in this array is that the off-angle response will be multiplied by the directional pattern described by Equation (12). The effect would be that, for instance, the plot shown in FIG. 3 would also show an amplitude difference as the principal lobe was steered from left to right. All the curves in FIG. 3 would be multiplied by Equation (12). Note that the peak amplitude of the principal lobes in FIG. 3 can be normalized by simply correcting for the expected attenuation due to the directional characteristics of the microphones.

As noted in the work of Gerzon cited in the Background section, it is also possible to take the voltages from the anterior and posterior diaphragms separately, thus producing two separate feeds from each microphone. These can then be combined later to produce directional characteristics. For instance, one might weight the anterior diaphragm by one-half and the posterior diaphragm by minus one-half and sum them to produce a forward-facing cardioid pickup, with 100% rejection of sounds coming from directly behind. Alternately, one might weight the posterior diaphragm with one-half and the anterior diaphragm with minus one-half to produce a rear-facing cardioid pickup with 100% rejection of sounds coming from directly in front. In this manner, a single array of pressure-gradient microphones can be used to mix the feeds of the diaphragms differently so that the same microphone array may be used for sounds in front of the array and behind the array with equal angular resolution and identical fidelity (frequency-response). Of course, filtering similar to that shown in FIG. 9 would be duplicated for the rear-facing array.

With phased-array radar, there is always the explicit assumption that the incoming wave is a plane wave. With the phased-array microphone, the plane wave assumption may be used when the sound sources are sufficiently distant from the microphone itself. If this is not the case, the wavefront will be curved. This curvature may corrected if the location of the sound source is known. If the plane-wave approximation can be made, the distance between the sound source and the array is not needed.

To correct for the curvature of the wavefront, a correction is applied to the amplitude and to the arrival time. The amplitude correction is needed to offset the $1/r^2$ attenuation the wavefront experiences. The correction to the arrival time is necessary since the curvature will have the effect of delaying the off-center parts of the wavefront. This can be quantized as follows: Let $\theta$ and $r_0$ be the angle and distance from the sound source to the center microphone of the array. The amplitude and time delay compensation is then:

$$P_n = r_n^2 / r_0^2 = \cos^2\theta + \left(\sin\theta - n\frac{d}{r_0}\right)^2 \tag{13}$$

$$\Delta_n = \frac{r_n - r_0}{c} = \frac{1}{c}\left\{\sqrt{r_0^2\cos^2\theta + (r_0\sin\theta - nd)^2} - r_0\right\} \tag{14}$$

where $r_n$ represents the distance from the sound source to microphone n. The feed from microphone n should be multiplied by $P_n$ and should be advanced by $\Delta_n$ seconds.

Since this correction is specific to the particular location of the sound source, it may be expected that the rejection of the off-axis sound would be affected and there may be more "leakage" from off-axis sounds when this kind of correction is applied.

Note that when the sound source consists of a number of discrete sources at known angles and possibly known distances, then the response in a particular direction can be enhanced by subtracting off the signals from the known directions. Of course, the delays across the varying angles must be equalized before a signal from one angle can be subtracted from a signal from another angle. This can be though of as a kind of analog to the lateral inhibition found in optical receptors in the retina of the eye.

So far in this exposition has operated under the implicit assumption that the microphones were identical. In practice this is, of course, not a valid assumption and there will be some mismatch. The effect of the mismatch can be examined to see what this requires of the microphones.

A worst-case bound on the error in the array can be obtained by taking the second term of Equation (2), applying a window function, assuming that the cosine term is always unity, and assuming that the microphone error is a uniform factor of $\epsilon$. This gives the following upper bound:

$$M = \varepsilon\left\{w_0 + 2\sum_{k=1}^{(n-1)/2} w_k\right\} \tag{15}$$

The window function is normalized so that the above sum (across all the points of the window function) is unity, so the error is bounded by the individual microphone error. The parameter $\epsilon$ can be taken to represent the expected value of the error. Some microphones will exhibit somewhat more error and some will exhibit somewhat less.

Figure 2:
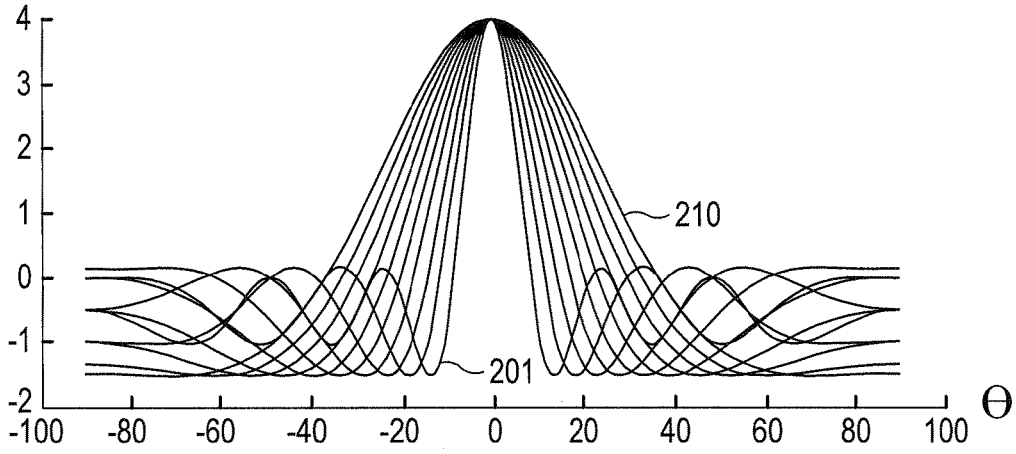
FIG. 2 shows the amplitude of the response of the sum of all the feeds from the microphone array with changing angle of incidence for different wavelengths.

A mean deviation of 1 dB then will produce error in the resulting pickup pattern that is about 18 dB down. The error discussed here is a distortion of the pickup pattern itself, as shown in FIGS. 2, 3, and 4. This is not so important for the principal lobe, but it can make a significant difference in the sideband suppression, since in some cases, the error will be of the same order of magnitude as the sideband amplitude itself. It can be expected that the actual sideband rejection will be several dB less than the theoretical values with a 1 dB variation among the microphones. Of course, better matching will allow more sideband rejection.

So far the discussion has only considered sounds coming from point sources that are in front of (or behind) the array. There may also be room reverberation, which can come from any direction. The room reverberation may (somewhat artificially) be divided into three epochs: the direct sound, the early reflections, and everything else. The direct sound and the early reflections can all be treated as point sources of sound. The array can be steered to pick up each one of these sources separately (or not, depending on the goals of the recording). The late reverberation can be considered to be omnidirectional, and will thus affect the array uniformly regardless of the steering direction. Of course, non-uniform reflections, such as slap echoes, will appear as specular reflections and thus will appear as point sources to the array.

Figure 12:
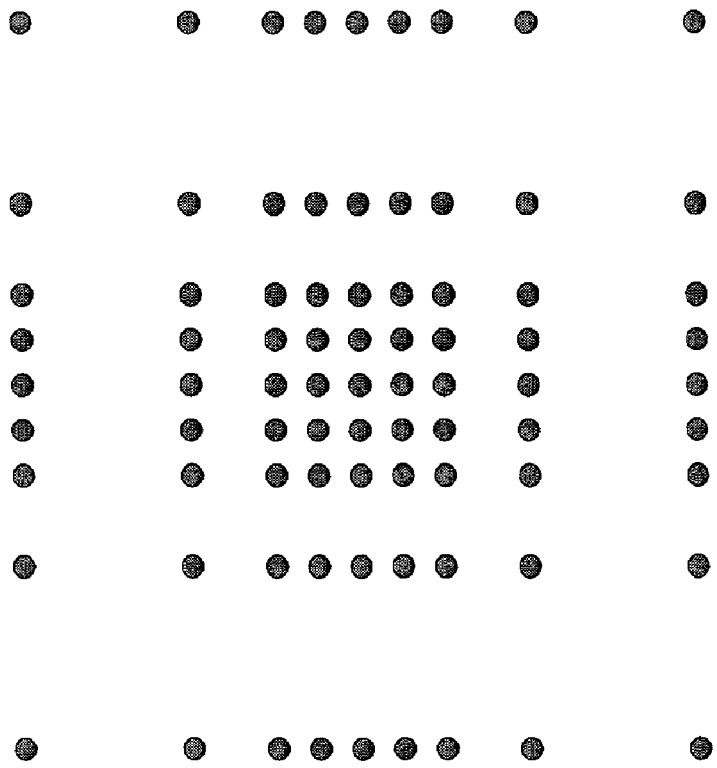
FIG. 12 shows a regular 2-dimensional array with equal resolution in horizontal and vertical directions.
Figure 13:
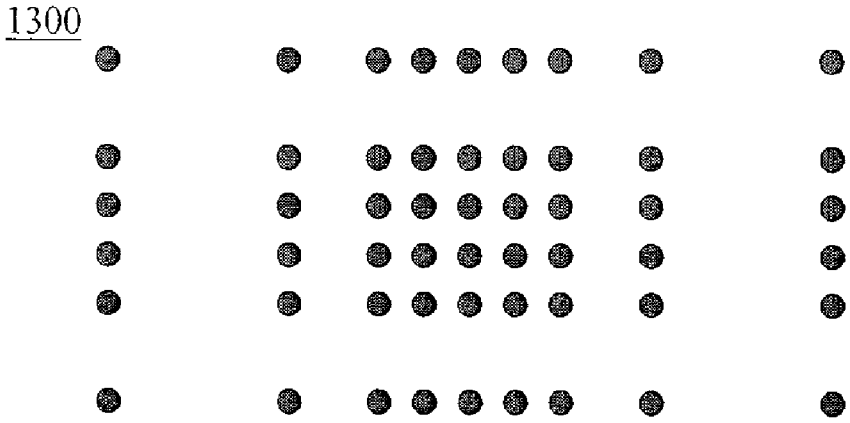
FIG. 13 is a 2-dimensional microphone array showing unequal resolution in vertical and horizontal directions.

The discussion may also be extended to more general arrangements. To extend the phased-array microphone to three dimensions, it must first extended to two dimensions. This can be done by extending the array as shown in FIG. 12. This shows a regular 2-dimensional array 1200 of microphones that is capable of steering plus or minus 45° in the horizontal direction and plus or minus 45° in the vertical direction. Note that for some applications, it may not be necessary to have the same resolution in the vertical direction as in the horizontal direction. FIG. 13 shows an array 1300 with higher resolution in the horizontal direction than in the vertical direction. Additionally, a more general arrangement need not use orthogonal axes to determine the spacing of the array. In this last case, the non-orthogonality can be compensated for in the signal processing.

Figure 14:
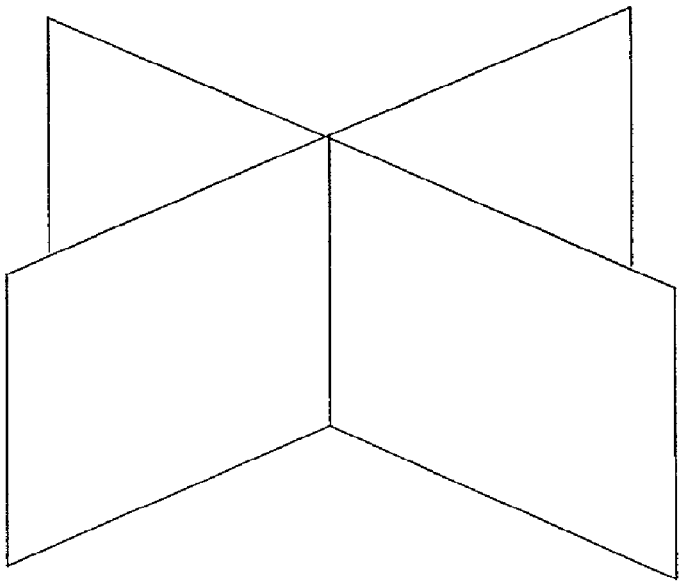
FIG. 14 shows two 2-dimensional arrays placed at right angles.

A single 2-dimensional array can only be steered across about a 90° range in the forward direction and a 90° range in the reverse direction. To allow steering through the full 360° range, multiple non-coplanar 2-dimensional arrays may be used. The simpler case 1400 of two arrays at right angles is shown in FIG. 14. Note that for this to work best, each array would preferably be acoustically "transparent", so that off-axis sounds will easily pass through it to reach the other array.

To extend the array to three dimensions, two 2-dimensional arrays shown in FIG. 14 can be taken and another array in the horizontal plane placed to cover the vertical direction. In this manner, pickup in any direction can be achieved.

Figure 15:
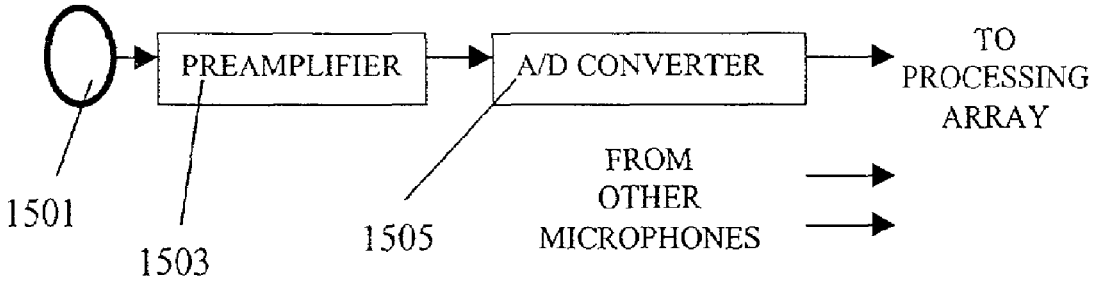
FIG. 15 shows an embodiment of the processing for a microphone in the array.

There is a wide range of ways to implement the array, depending on the goals of the implementation. One embodiment of the array would be to simply connect wires to each transducer in the array and run all the wires to the required processing hardware, with preprocessing for each transducer in the form of a microphone preamplifier and an A/D converter. FIG. 15 shows the processing for each microphone in the array in such an embodiment. In the direct implementation of FIG. 15, the array has a wire from each microphone 1501 in the array to the required preprocessing, including microphone preamplifier 1503 and A/D converter 1505. The output, along with that from other microphones in the array, then goes on to subsequent processing as shown in FIG. 9.

Of course, different technology can affect the elements in the figures. For instance, the use of electret or other microphone technology may render the pre-amplifier unnecessary. Similarly, it is possible to combine the microphone preamplifier (if any) with the first stage of the A/D converter. In any case, the result of the preprocessing is a sequence of digital audio samples. Since a large array may contain hundreds of microphones, running individual wires from each microphone to the required pre-processing and subsequent processing may be undesirable.

Figure 16:
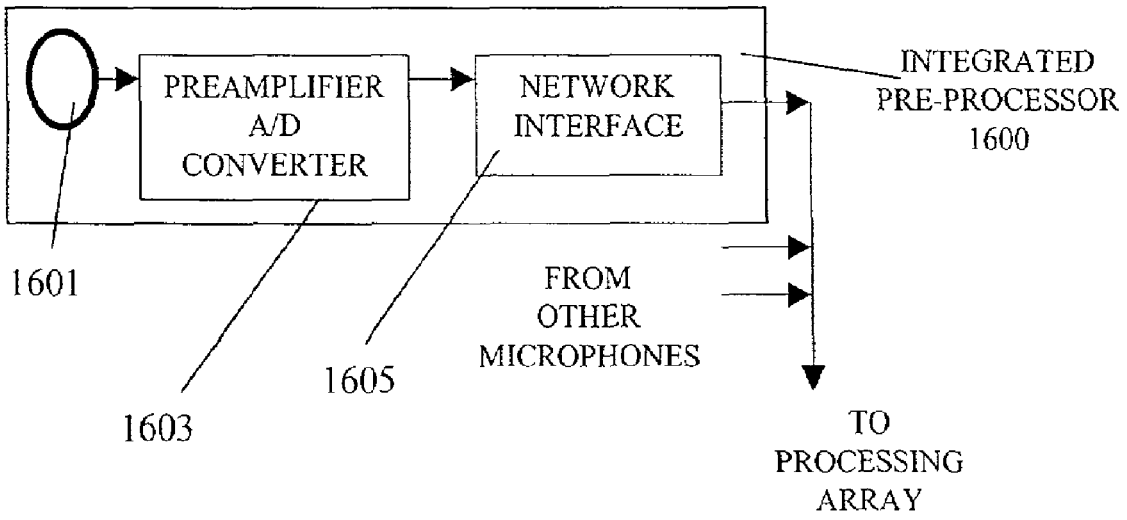
FIG. 16 shows an embodiment including the preprocessing and A/D conversion in the same physical location as the microphone capsule itself.

With modern technology, high-levels of integration are possible. Both analog and digital circuitry can be put into the same package, if not the same substrate. See, for instance, U.S. Pat. No. 5,051,799 of Paul et al., issued Sep. 24, 1991, which is hereby incorporated by reference. It is possible to produce a very compact realization of the preamplifier and D/A converter. It is even possible to combine the microphone preamplifier with the first stage of the D/A converter for even a more compact realization. Such circuitry can be on the order of the same size as the microphone capsule or even smaller. FIG. 16 shows the idea of including the preprocessing and A/D conversion in the same physical location as the microphone capsule itself.

In FIG. 16, the microphone capsule integrates the microphone 1601 with the pre-processing as the integrated preprocessor 1600. In this configuration, miniaturized preamplifier 1603 and A/D stages 1605 are integrated with some kind of multiplexing (network) interface that combines the signal with those of the other microphones. In addition, some kind of data multiplexing circuit is included with each microphone so that the outputs of multiple microphones may be combined into a single wire. A wide range of multiplexing technology may be used, ranging from simple time-domain or frequency-domain multiplexing (see, for example, U.S. Pat. No. 4,922,536 of Hoque, issued May 1, 1990, which is hereby included by reference) to computer-type network technology, such as Ethernet (see, for example, Metcalfe, R. M., and Boggs, D. R. "Ethernet: Distributed Packet Switching for Local Computer Networks", *Communications of the ACM*, Volume 19, Number 7, pp 395-404, July 1976 which is hereby included by reference). The end result of this multiplexing is that the data from the entire array is available in a small number of cables, or even a single cable, in a manner such that the samples from each individual microphone may be separated for the required spatial processing as shown in FIG. 9.

Figure 17:
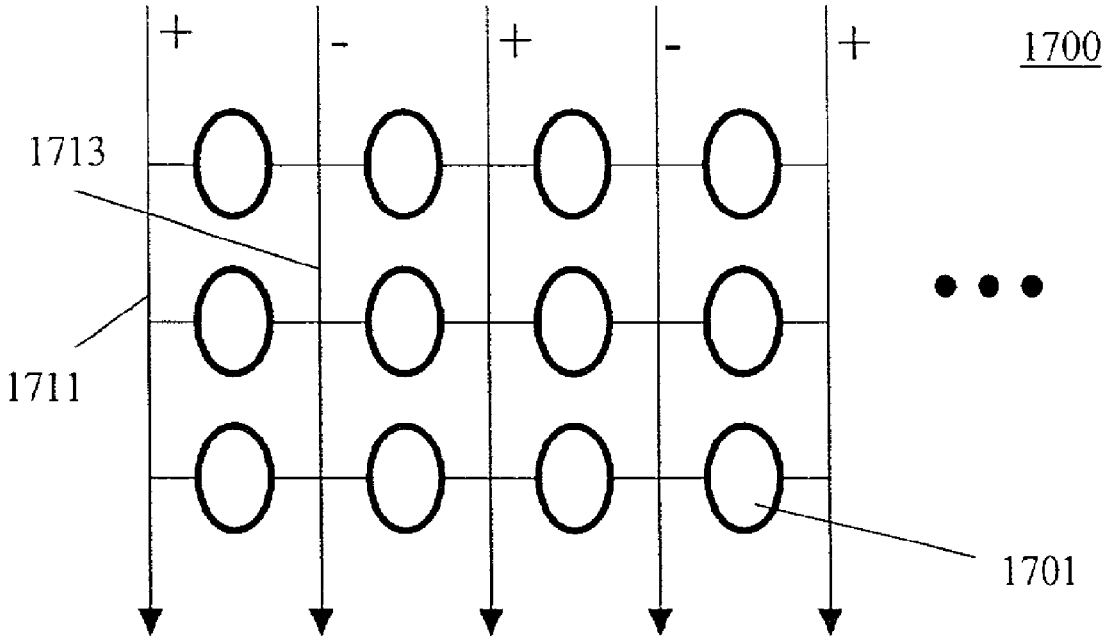
FIG. 17 shows an embodiment as a microphone array "fabric".

FIG. 17 shows the extension of this sort of embodiment to the microphone array "fabric". In this embodiment, power is fed to each transducer/processor/multiplexor node via alternating vertical positive and negative supply wires.

Each oval, such as 1701, represents a complete transducer, preprocessor, and network interface as shown in FIG. 16. This figure shows how the array may be powered by a vertical array of alternating positive, such as 1711, and negative supplies, such as 1713. One rail (e.g. the positive wires like as 1711) may also serve as the medium for the network (or additional wires may be used for the network interface) by AC-coupling the data back onto the wire. Similarly, clock distribution to the individual A/D converters may be accomplished by placing the clock itself on one of the supply wires. By use of frequency-domain multiplexing, the data can be placed on the wire in frequency bands that are well above the clock frequency.

Note that the entire array could just as easily be wireless (except for the supply rails). Each node could simply broadcast a low-power RF signal that could be received and demultiplexed for further processing. Each node would have some unique ID in the form of a network address, a dedicated frequency, a dedicated time slot, or any other way of identifying the node so that the samples may be recovered and related back to the original array position of the node.

Any medium of transmission could be used to convey the data from the array to the processing elements. For instance, each node could emit digital data as light on wavelengths that people can not see. The data could be multiplexed either by the wavelength of the individual lights, or by time so that only one node transmitted data at a time.

Hybrid schemes are also possible. That is, "clusters" of some number of nodes in a particular area could be multiplexed together with, say, fiber-optic cables used to relay the data from each cluster back to the spatial processing equipment.

Although the various aspects of the present invention have been described with respect to specific exemplary embodiments, it will be understood that the invention is entitled to protection within the full scope of the appended claims.

It is claimed:

1. A microphone system comprising:

a planar array of microphones regularly spaced in a first axis according to pluralities of first spacings and regularly spaced in a second axis according to pluralities of second spacings, wherein the first and second axes are linear and nondegenerate;

a plurality of adders, wherein the microphones regularly spaced in the first axis are connected to one adder and the microphones regularly spaced in the second axis are connected to another adder;

a plurality of first filters, each first filter connected to receive an output of a corresponding adder of the plurality of adders;

an output adder connected to generate a combined signal by summing outputs of the first filters; and a plurality of second filters, each second filter connecting a corresponding microphone to a corresponding one of the plurality of adders;

wherein a first set of microphones is configured to produce cardioid pickups in a first direction; and wherein a second set of microphones is configured to produce cardioid pickups in a second direction opposite the first direction such that the planar array establishes equal angular resolution in both the first and second directions.

2. The microphone system of claim 1, wherein the second filters implement windowing functions.

3. The microphone system of claim 2, wherein the windowing functions are Kaiser-Bessel windowing functions.

4. The microphone system of claim 1, wherein the second filters implement a delay.

5. The microphone system of claim 4, wherein the delay of a second filter is proportional to the first or second spacings.

6. The microphone system of claim 1, wherein the frequency response of each of the first filters is a continuous function of frequency, the response of the first filter corresponding to a smallest spacing being zero below a first frequency, constant above a second frequency, and linear between the first and second frequencies, the response of the first filter corresponding to a largest spacing being zero above a third frequency, constant below a fourth frequency, and linear between the third and fourth frequencies; and wherein for each of the other first filters, the response is zero outside of a respective frequency range and, inside the respective frequency range, the response linearly increases below a respective intermediate frequency and linearly decreases above the respective intermediate frequency.

7. The microphone system of claim 6, wherein the respective frequency range is greater than five octaves.

8. The microphone system of claim 6, wherein the respective frequency range is from 20 hertz to 20 kilohertz.

9. The microphone system of claim 1, wherein a number of first spacings is $N_1$ and the first spacings are $2^{(I-1)}d_1$, where i runs from one to $N_1$ and $d_1$ is a smallest spacing in the first axis; and wherein a number of second spacings is $N_2$ and the second spacings are $2^{(J-1)}d_2$, where j runs from one to $N_2$ and $d_2$ is a smallest spacing in the second axis.

10. The microphone system of claim 9, wherein $N_1$ and $N_2$ are equal to nine.

11. The microphone system of claim 9, wherein $d_1$ and $d_2$ are in a range of 0.5 centimeters to ten centimeters.

12. The microphone system of claim 9, wherein the planar array comprises three or more microphones of first spacings and three or more microphones of second spacings.

13. The microphone system of claim 9, wherein $d_1$ is equal to $d_2$.

14. The microphone system of claim 1, wherein the axes are orthogonal.

15. The microphone system of claim 1, comprising two or more non-coplanar arrays of microphones.

16. The microphone system of claim 15 comprising two or more orthogonal planar arrays.

17. A method of providing a directional response to a sonic input that is flat over a frequency range, comprising:

receiving the sonic input at a plurality of microphones arranged according to pluralities of distinct regular spacings in a planar array having linear and nondegenerate axes;

for each of the spacings, combining responses of the corresponding microphones to the sonic input;

filtering each of the combined responses with a frequency response dependent upon the respective spacing;

combining the filtered responses such that the combined output is flat over the frequency range in a selected direction;

supplying a plurality of voltages to a first set of microphones to produce cardioid pickups in a first direction;

supplying a plurality of voltages to a second set of microphones to produce cardioid pickups in a second direction opposite the first direction such that a sonic input is detected on opposite sides of the first and second sets of microphones with an equal angular resolution; and filtering the responses of the microphones with windowing filters prior to combining the filtered responses.

18. The method of claim 17, wherein the windowing filters are Kaiser-Bessel window filters.

19. The method of claim 17, further comprising:

causing a delay of the responses of the microphones prior to combining the responses to maximize a directional response to the audio signal in the selected direction.

20. The method of claim 17, wherein the frequency range is greater than five octaves.

21. The method of claim 17, wherein the frequency range is from 20 hertz to 20 kilohertz.

22. A method of providing a directional audio response that is flat over a selected frequency range, comprising:

providing a plurality of microphones arranged according to pluralities of distinct regular spacings in a planar array having linear and nondegenerate axes;

applying one of a plurality of windowing functions to an output of each of the plurality of microphones responsive to at least one of the pluralities of spacings;

combining outputs of the plurality of windowing functions to provide a respective combined signal for each of the spacings;

filtering each combined signal according to a respective frequency response;

combining the filtered combined signals, wherein the spacings and respective filter responses are related such that the combined signals is flat over the selected frequency range;

supplying a plurality of voltages to a first set of the plurality of microphones to produce cardioid pickups in a first direction; and supplying a plurality of voltages to a second set of the plurality of microphones to produce cardioid pickups in a second direction opposite the first direction such that an input is detected on opposite sides of the first and second sets of microphones with an equal angular resolution.

23. The method of claim 22, wherein the microphones are arranged collinearly and the pluralities of distinct regular spacings share a common center.

24. The method of claim 23, wherein a number of spacings is N and the spacings are $2^{(i-1)}d$, where i runs from one to N and d is a smallest spacing.

25. The method of claim 24, wherein N is equal to nine.

26. The method of claim 24, wherein d is in a range of 0.5 centimeters to ten centimeters.

27. The method of claim 24, wherein three or more microphones correspond to each of the spacings.

28. The method of claim 22, wherein the applying one of the plurality of windowing functions comprises filtering outputs of the microphones with windowing filters prior to combining the outputs of the microphones.

29. The method of claim 28, wherein the windowing filters are Kaiser-Bessel window filters.

30. The method of claim 28, further comprising:

delaying outputs of the microphones prior to combining the outputs of the microphones, whereby audio response is maximized in a selected direction.

31. The method of claim 30 wherein delaying the outputs of the microphones comprises delaying the outputs of the microphones by a delay proportional to the spacing of a particular set of microphones.

32. The method of claim 22, wherein the respective response corresponding to a smallest spacing is zero below a first frequency, constant above a second frequency, and linear between the first and second frequency;

wherein the respective response corresponding to a largest spacing is zero above a third frequency, constant below a fourth frequency, and linear between the third and fourth frequency; and wherein the respective response corresponding to spacings other than the smallest or the largest spacing is zero outside of a respective frequency range and, inside the respective frequency range, linearly increases below a respective intermediate frequency and linearly decreases above the respective intermediate frequency.

33. The method of claim 22, wherein the selected frequency range is greater than five octaves.

34. The method of claim 22, wherein the selected frequency range is from 20 hertz to 20 kilohertz.

35. A microphone system comprising:

a plurality of first microphones having a first regular spacing and arranged along a first axis;

a plurality of second microphones having a second regular spacing and arranged along a second axis, the first and second axes being linear and nondegenerate;

a plurality of first filters, each first filter configured to generate first filter outputs by applying a first windowing function to an output of a corresponding first microphone;

a plurality of second filters, each second filter configured to generate second filter outputs by applying a second windowing function to an output of a corresponding second microphone;

a first adder to generate a first adder output by adding the first filter outputs;

a second adder to generate a second adder output by adding the second filter outputs; and an output adder to generate a combined signal by adding the first adder output to the second adder output;

wherein a first set of the plurality of first or second microphones or their combination is configured to produce cardioid pickups in a first direction;

wherein a second set of the plurality of first or second microphones or their combination is configured to produce cardioid pickups in a second direction opposite the first direction such that a planar array formed with the plurality of first and second microphones establishes equal angular resolution in both the first and second directions;

wherein the first and second windowing functions correspond to the first and second regular spacings, respectively; and wherein the combined signal comprises a flat frequency response over a selected frequency range in a selected direction.

36. The microphone system of claim 35, wherein the first or second windowing functions comprises a Kaiser-Bessel windowing function.

37. The microphone system of claim 35, wherein each of the first filters is configured to implement a first delay; and wherein each of the second filters is configured to implement a second delay.

38. The microphone system of claim 37, wherein the first delay is proportional to the first regular spacing;

wherein the second delay is proportional to the second regular spacing; and wherein both the plurality of first filters and the plurality of second filters depend upon a same function of a steering angle.

39. The microphone system of claim 35, further comprising:

a first overlap filter located between the first signal adder and the output adder and configured to filter the first filter output; and a second overlap filter located between the second signal adder and the output adder and configured to filter the second filter output.

40. A method, comprising:

generating a plurality of first outputs responsive to receiving a sonic input at a plurality of first microphones arranged collinearly along a first axis with a first spacing between adjacent first microphones;

filtering the plurality of first outputs with a first window function to generate a corresponding plurality of first filter outputs;

adding the plurality of first filter output to generate a first adder output;

overlap filtering the first adder output to generate a first overlap output;

generating a plurality of second outputs responsive to receiving the sonic input at a plurality of second microphones arranged collinearly along a second axis with a second spacing between adjacent second microphones, the first and second axes being linear and nondegenerate;

filtering the plurality of second outputs with a second window function to generate a corresponding plurality of second filter outputs;

adding the plurality of second filter output to generate a second adder output;

overlap filtering the second adder output to generate a second overlap output;

adding the first overlap output to the second overlap output to generate a combined signal having a flat frequency response over a frequency range in a predetermined direction;

supplying a plurality of voltages to a first set of the plurality of first and/or second microphones to produce cardioid pickups in a first direction; and supplying a plurality of voltages to a second set of the plurality of first and/or second microphones to produce cardioid pickups in a second direction opposite the first direction such that the sonic input is detected on opposite sides of the first and second sets of microphones with an equal angular resolution.

41. The method of claim 40, wherein the first windowing function comprises a first Kaiser-Bessel function; and wherein the second windowing function comprises a second Kaiser-Bessel function.

42. The method of claim 40, further comprising:

delaying the first outputs by a first delay proportional to the first spacing; and delaying the second output by a second delay proportional to the second spacing.

* * * * *

UNITED STATES PATENT AND TRADEMARK OFFICE

CERTIFICATE OF CORRECTION

PATENT NO. : 7,756,278 B2
APPLICATION NO. : 11/419460
DATED : July 13, 2010
INVENTOR(S) : Moorer It is certified that error appears in the above-identified patent and that said Letters Patent is hereby corrected as shown below:

Title Page 2, item (56), under "Other Publications", in Column 2, Line 21, delete "(This is" and insert -- This is --.

Column 14, line 35, in Claim 9, delete "$2^{(I-1)}d_1$," and insert -- $2^{(i-1)}d_1$, --.

Column 14, line 38, in Claim 9, delete "$2^{(J-1)}d_2$," and insert -- $2^{(j-1)}d_2$, --.

Column 16, line 1, in Claim 31, delete "claim 30 wherein" and insert -- claim 30, wherein --.

Signed and Sealed this
Nineteenth Day of June, 2012

David J. Kappos

David J. Kappos
*Director of the United States Patent and Trademark Office*